US008597052B2

(12) United States Patent
Davis et al.

(10) Patent No.: US 8,597,052 B2
(45) Date of Patent: Dec. 3, 2013

(54) GROUNDING STRUCTURES FOR HEADER AND RECEPTACLE ASSEMBLIES

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 175 days.

(21) Appl. No.: 13/182,152

(22) Filed: Jul. 13, 2011

(65) Prior Publication Data

US 2013/0017723 A1 Jan. 17, 2013

(51) Int. Cl.
*H01R 13/648* (2006.01)

(52) U.S. Cl.
USPC ..... 439/607.08

(58) Field of Classification Search
USPC ..... 439/607.28, 701, 408, 620.22, 620.01, 439/941, 101, 79
See application file for complete search history.

(56) References Cited

U.S. PATENT DOCUMENTS

| | | | | |
|---|---|---|---|---|
| 6,540,558 | B1 * | 4/2003 | Paagman | 439/607.11 |
| 6,551,140 | B2 * | 4/2003 | Billman et al. | 439/607.07 |
| 6,843,687 | B2 * | 1/2005 | McGowan et al. | 439/607.06 |
| 7,878,853 | B2 * | 2/2011 | Amleshi et al. | 439/607.08 |
| 8,062,070 | B2 * | 11/2011 | Jeon et al. | 439/620.22 |
| 8,187,034 | B2 * | 5/2012 | Fedder et al. | 439/607.01 |
| 8,226,441 | B2 * | 7/2012 | Regnier et al. | 439/626 |

* cited by examiner

*Primary Examiner* — Jean F Duverne

(57) ABSTRACT

A receptacle assembly has a front housing configured to be mated with a header assembly. A contact module is coupled to the front housing. The contact module includes a conductive holder that has an open first side and a closed second side. The conductive holder has a chamber between the first and second sides. The conductive holder has a front coupled to the front housing. A frame assembly is received in the chamber through the open first side. The frame assembly includes a first dielectric frame that has a plurality of contacts and a second dielectric frame that has a plurality of contacts. The first and second dielectric frames both are received in the chamber of the conductive holder. The contacts extend from the conductive holder for electrical termination. A ground shield is coupled to the conductive holder and closes the open first side. The ground shield is electrically connected to the conductive holder. The ground shield has grounding beams that extend forward of the front of the conductive holder for electrical connection to a corresponding header shield of the header assembly.

20 Claims, 5 Drawing Sheets

GROUNDING STRUCTURES FOR HEADER AND RECEPTACLE ASSEMBLIES

BACKGROUND OF THE INVENTION

The subject matter herein relates generally to grounding connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact.

Additionally, carrying the shielding across the interface between the electrical connector and the circuit board has proven to be difficult. Some known systems use a plurality of ground bars that interconnect the electrical connector and the circuit board. Assembly of the ground bars is complicated. The ground bars increase the number of components required for assembly of the system.

A need remains for an electrical system that provides efficient shielding to meet particular performance demands. A need remains for an electrical system that provides redundant grounding connections. A need remains for an electrical connector that is efficiently electrically grounded to a circuit board.

BRIEF DESCRIPTION OF THE INVENTION

In one embodiment, a receptacle assembly is provided having a front housing configured to be mated with a header assembly. A contact module is coupled to the front housing. The contact module includes a conductive holder that has an open first side and a closed second side. The conductive holder has a chamber between the first and second sides. The conductive holder has a front coupled to the front housing. A frame assembly is received in the chamber through the open first side. The frame assembly includes a first dielectric frame that has a plurality of contacts and a second dielectric frame that has a plurality of contacts. The first and second dielectric frames both are received in the chamber of the conductive holder. The contacts extend from the conductive holder for electrical termination. A ground shield is coupled to the conductive holder and closes the open first side. The ground shield is electrically connected to the conductive holder. The ground shield has grounding beams that extend forward of the front of the conductive holder for electrical connection to a corresponding header shield of the header assembly.

In another embodiment, a receptacle assembly is provided having a front housing configured to be mated with a header assembly. The front housing has contact openings therethrough. A contact module is coupled to the front housing. The contact module includes a conductive holder that has an open first side and a closed second side. The conductive holder has a chamber between the first and second sides. The conductive holder has a front coupled to the front housing. A frame assembly is received in the chamber through the open first side. The frame assembly includes a first dielectric frame that has a plurality of contacts and a second dielectric frame that has a plurality of contacts. The first and second dielectric frames both are received in the chamber of the conductive holder. The contacts extend from the conductive holder into corresponding contact openings for electrical termination to header contacts of the header assembly. A first ground shield is coupled to the conductive holder and closes the open first side. The first ground shield is electrically connected to the conductive holder. The first ground shield has grounding beams that extend forward of the front of the conductive holder into corresponding contact openings for electrical connection to a wall of a corresponding C-shaped header shield of the header assembly. A second ground shield is coupled to the second side of the conductive holder. The second ground shield is electrically connected to the conductive holder. The second ground shield has grounding beams that extend forward of the front of the conductive holder into corresponding contact openings for electrical connection to a wall of a corresponding C-shaped header shield of the header assembly.

In a further embodiment, an electrical connector assembly is provided having a header assembly that includes a header housing. A plurality of header contacts are held by the header housing, and a plurality of C-shaped header shields surround corresponding header contacts on three sides. The header shields have walls that define the C-shaped header shields. A receptacle assembly is matable to the header assembly. The receptacle assembly includes a front housing that is matable to the header housing. A contact module is coupled to the front housing. The contact module includes a conductive holder that has an open first side and a closed second side. The conductive holder has a chamber between the first and second sides. The conductive holder has a front coupled to the front housing. A frame assembly is received in the chamber through the open first side. The frame assembly includes a first dielectric frame that has a plurality of contacts and a second dielectric frame that has a plurality of contacts. The first and second dielectric frames both are received in the chamber of the conductive holder. The contacts extend from the conductive holder for electrical termination to corresponding header contacts. A ground shield is coupled to the conductive holder and closing the open first side. The ground shield is electrically connected to the conductive holder. The ground shield has grounding beams that extend forward of the front of the conductive holder for electrical connection to a corresponding wall of a corresponding header shield.

DETAILED DESCRIPTION OF THE INVENTION

Figure 1:
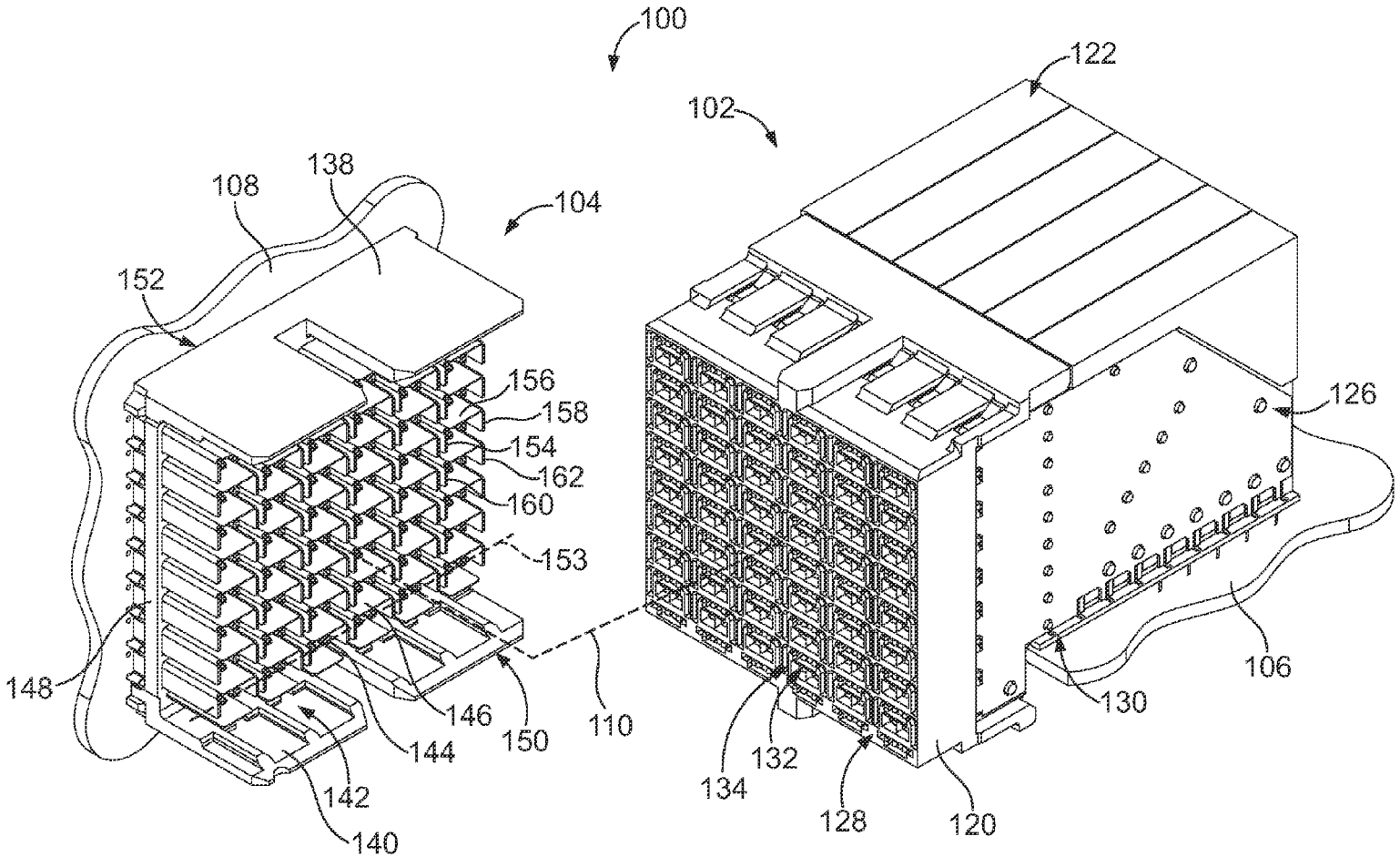
FIG. 1 is a perspective view of an exemplary embodiment of an electrical connector system illustrating a receptacle assembly and a header assembly.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding projections, such as grounding beams 302, 332 (shown in FIG. 2) of the contact modules 122, which mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The wall 156 defines a main wall or top wall of the header shields 146. The walls 154, 158 define side walls that extend from the main wall 156. The walls 154, 156, 158 may be integrally formed or alternatively, may be separate pieces.

The header shields 146 have edges 160, 162 at opposite ends of the header shields 146. The edges 160, 162 are downward facing. The edges 160, 162 are provided at the distal ends of the walls 154, 158, respectively. The bottom of the header shield 146 is open between the edges 160, 162. The header shield 146 associated with another pair of header signal contacts 144 provides the shielding along the open, fourth side thereof such that each of the pairs of signal contacts 144 is shielded from the adjacent pair in the same column and from adjacent pairs in the same row. For example, the main wall 156 of the header shield 146 below a particular header shield 146 provides shielding across the open bottom of the C-shaped header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding to individual signal contacts 144 or sets of contacts having more than two signal contacts 144.

Figure 2:
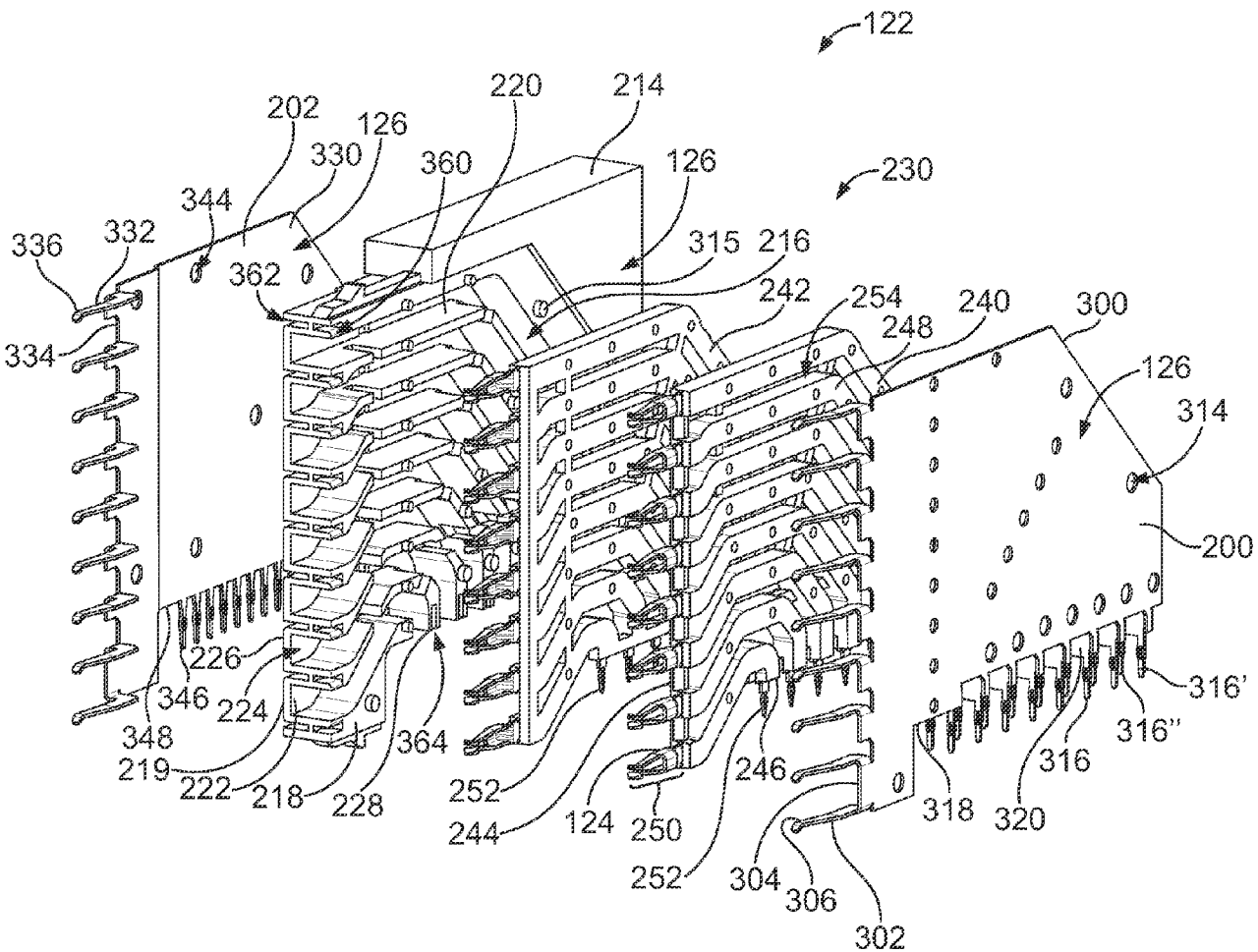
FIG. 2 is an exploded view of a contact module of the receptacle assembly shown in FIG. 1.

FIG. 2 is an exploded view of one of the contact modules 122 and part of the shield structure 126. The shield structure 126 includes a first ground shield 200 and a second ground shield 202. The first and second ground shields 200, 202 electrically connect the contact module 122 to the header shields 146 (shown in FIG. 1). The first and second ground shields 200, 202 provide multiple, redundant points of contact to the header shield 146. The first and second ground shields 200, 202 provide shielding for the receptacle signal contacts 124.

The contact module 122 includes a conductive holder 214 having a chamber 216 that receives a frame assembly 230. The holder 214 is fabricated from a conductive material. For example, the holder 214 may be die-cast from a metal material. Alternatively, the holder 214 may be stamped and formed or may be fabricated from a plastic material that has been metalized or coated with a metallic layer. By having the holder 214 fabricated from a conductive material, the holder 214 may provide electrical shielding for the receptacle assembly 102. The holder 214 defines at least a portion of the shield structure 126 of the receptacle assembly 102.

The holder 214 has an open first side 218 and a closed second side 219. The chamber 216 is open at the first side 218. The holder 214 includes tabs 220 extending inward into the chamber 216 from a side wall 222 that defines the second side 219. Optionally, the tabs 220 may extend to the first side 218. The distal ends of the tabs 220 may define the first side 218. The tabs 220 parse the chamber 216 into individual channels 224. The tabs 220 define at least a portion of the shield structure 126 of the receptacle assembly 102. The holder 214 includes a front 226 and a bottom 228, with the channels 224 extending from the front 226 to the bottom 228.

The contact module 122 includes a frame assembly 230, which is held in the chamber 216. The frame assembly 230 includes the receptacle signal contacts 124. In an exemplary embodiment, the frame assembly 230 includes a pair of dielectric frames 240, 242 surrounding the receptacle signal contacts 124. Both dielectric frames 240, 242 are loaded into the chamber 216 through the open first side 218. The tabs 220 and chamber 216 are wide enough to accommodate and hold both dielectric frames 240, 242.

In an exemplary embodiment, the receptacle signal contacts 124 are initially held together as lead frames (not shown), which are overmolded with dielectric material to form the dielectric frames 240, 242. Other manufacturing processes may be utilized to form the contact modules 122 other than overmolding a lead frame, such as loading receptacle signal contacts 124 into a formed dielectric body.

The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 214 and the contact tails 252 extend downward from the bottom 228 of the holder 214.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

The dielectric frame 242 is similar to the dielectric frame 240 and includes similar features. During assembly, the dielectric frames 240, 242 are loaded into the chamber 216. The frame members 248 are received in corresponding channels 224. The tabs 220 are received in corresponding windows 254 such that the tabs 220 are positioned between adjacent receptacle signal contacts 124.

The holder 214, which is part of the shield structure 126, provides electrical shielding between and around respective receptacle signal contacts 124. The holder 214 provides shielding from electromagnetic interference (EMI) and/or radio frequency interference (RFI). The holder 214 may provide shielding from other types of interference as well. The holder 214 provides shielding around and between the frames 240, 242, and thus around and between the receptacle signal contacts 124, such as between pairs of receptacle signal contacts 124, to control electrical characteristics, such as impedance control, cross-talk control, and the like, of the receptacle signal contacts 124.

The first ground shield 200 is used in conjunction with the holder 214 to provide shielding for the receptacle signal contacts 124. The first ground shield 200 covers the open first side 218 of the holder 214. The first ground shield 200 provides shielding along the exposed side of the dielectric frame 240. Optionally, the first ground shield 200 may engage the outer side (e.g. the side opposite the second dielectric frame 242) of the dielectric frame 240. The first ground shield 200 may be used to retain the dielectric frames 240, 242 in the chamber 216.

The first ground shield 200 includes a main body 300. In the illustrated embodiment, the main body 300 is generally planar. The ground shield 200 includes projections, such as grounding beams 302, which extend forward from a front 304 of the main body 300. In an exemplary embodiment, the grounding beams 302 are bent inward out of plane with respect to the main body 300 such that the grounding beams 302 are oriented perpendicular with respect to the plane defined by the main body 300. The grounding beams 302 are bent inward toward the holder 214 and dielectric frames 240, 242.

In an exemplary embodiment, the first ground shield 200 is manufactured from a metal material. The ground shield 200 is a stamped and formed part with the grounding beams 302 being stamped and then bent during the forming process out of plane with respect to the main body 300. Optionally, the main body 300 may extend vertically while the grounding beams 302 may extend horizontally, however other orientations are possible in alternative embodiments.

Each grounding beam 302 has a mating interface 306 at a distal end thereof. The mating interface 306 is configured to engage the corresponding header shield 146. The grounding beams 302 are configured to extend forward from the front 226 of the holder 214 such that the grounding beams 302 may be loaded into the front housing 120 (shown in FIG. 1).

The first ground shield 200 includes a plurality of mounting openings 314 in the main body 300. The mounting openings 314 are configured to be coupled to the holder 214. For example, the mounting openings 314 may receive posts 315 extending from the holder 214 that are staked to secure the first ground shield 200 to the holder 214. The posts 315 engage the first ground shield 200 to electrically connect the first ground shield 200 to the holder 214. Any number of mounting openings 314 and posts 315 may be provided. The first ground shield 200 may be secured to the holder 214 by other means in alternative embodiments.

The first ground shield 200 includes a plurality of ground pins 316 extending from a bottom 318 of a ground tab 320 that is bent substantially perpendicular from the main body 300. The ground pins 316 are configured to be terminated to the circuit board 106 (shown in FIG. 1). The ground pins 316 may be compliant pins, such as eye-of-the-needle pins, that are through-hole mounted to plated vias in the circuit board 106. Other types of termination means or features may be provided in alternative embodiments to couple the first ground shield 200 to the circuit board 106. In an exemplary embodiment, two ground pins 316 extend from each ground tab 320. One of the ground pins 316' is configured to be generally aligned with the receptacle signal contacts 124 of the first dielectric frame 240 while the other ground pin 316" is configured to be generally aligned with the receptacle signal contacts 124 of the second dielectric frame 242. The ground pins 316', 316" may be offset with respect to the receptacle signal contacts 124.

In an exemplary embodiment, the ground pins 316 are configured to extend into the holder 214 and dielectric frames 240, 242. The ground pins 316 are positioned between, and generally aligned with, the contact tails 252 of both the dielectric frames 240, 242. The ground pins 316' are generally located in the column of receptacle signal contacts 124 to provide shielding between the receptacle signal contacts 124 held by the dielectric frame 240. The ground pins 316" are generally located in the column of receptacle signal contacts 124 to provide shielding between the receptacle signal contacts 124 held by the dielectric frame 242. Optionally, the ground tab 320 and ground pins 316 may be stamped and then bent inward during the forming process out of plane with respect to the main body 300.

The second ground shield 202 includes a main body 330. In the illustrated embodiment, the main body 330 is generally planar. The second ground shield 202 includes grounding beams 332 extending forward from a front 334 of the main body 330. In an exemplary embodiment, the grounding beams 332 are bent inward out of plane with respect to the main body 330 such that the grounding beams 332 are oriented perpendicular with respect to the plane defined by the main body 330. The grounding beams 332 are bent inward toward the holder 214 and dielectric frame 242.

In an exemplary embodiment, the second ground shield 202 is manufactured from a metal material. The ground shield 202 is a stamped and formed part with the grounding beams 332 being stamped and then bent during the forming process out of plane with respect to the main body 330. Optionally, the main body 330 may extend vertically while the grounding beams 332 may extend horizontally, however other orientations are possible in alternative embodiments.

Each grounding beam 332 has a mating interface 336 at a distal end thereof. The mating interface 336 is configured to engage the corresponding header shield 146. The grounding beams 332 are configured to extend forward from the front 226 of the holder 214 such that the grounding beams 332 may be loaded into the front housing 120 (shown in FIG. 1).

The second ground shield 202 includes a plurality of mounting openings 344 in the main body 330. The mounting openings 344 are configured to be coupled to the holder 214. For example, the mounting openings 344 may receive posts (not shown) extending from the side wall 222 of the holder 214 that are staked to secure the second ground shield 202 to the holder 214. The posts engage the second ground shield 202 to electrically connect the second ground shield 202 to the holder 214. Any number of mounting openings 344 and posts may be provided. The second ground shield 202 may be secured to the holder 214 by other means in alternative embodiments.

The second ground shield 202 includes a plurality of ground pins 346 extending from a bottom 348 of the second ground shield 202. The ground pins 346 are configured to be terminated to the circuit board 106 (shown in FIG. 1). The ground pins 346 may be compliant pins, such as eye-of-the-needle pins, that are through-hole mounted to plated vias in the circuit board 106. Other types of termination means or features may be provided in alternative embodiments to couple the second ground shield 202 to the circuit board 106.

In an exemplary embodiment, the ground pins 346 remain outside and along the side wall 222 of the holder 214. The ground pins 346 are offset with respect to the receptacle signal contacts 124 outside of the envelope of the holder 214. The ground pins 346 are located to provide shielding between the receptacle signal contacts 124 of the contact module 122 and receptacle signal contacts 124 of an adjacent contact module 122 within the receptacle assembly 102. For example, the ground pins 346 are generally aligned with the interface between two adjacent contact modules 122. The ground pins 346 may be generally aligned with the plane of the main body 330 of the second ground shield 202. Optionally, the main body 300 may include a jogged section 358 that slightly shifts the front of the second ground shield 202 and the ground pins 346 out of the plane of the main body 330, such as to align the ground pins 346 at a central plane between two adjacent holders 214 and the receptacle signal contacts 124 of the contact modules 122 of the adjacent holders 214.

In an exemplary embodiment, the holder 214 includes slots 360, 362 in the front 226 thereof that receive the grounding beams 302, 332, respectively, therein when the ground shields 200, 202 are coupled thereto. In an exemplary embodiment, the slots 360, 362 are vertically offset with respect to the receptacle signal contacts 124. When the grounding beams 302, 332 are received in the slots 360, 362, the grounding beams 302, 332 are vertically offset with respect to the receptacle signal contacts 124. For example, the grounding beams 302, 332 may be positioned above and/or below corresponding receptacle signal contacts 124. In an exemplary embodiment, the grounding beams 302 are vertically aligned (e.g. along a vertical axis) with the receptacle signal contacts 124 of the dielectric frame 240 and the grounding beams 332 are vertically aligned (e.g. along a vertical axis) with the receptacle signal contacts 124 of the dielectric frame 242. The grounding beams 302, 332 provide electrical shielding between one row of receptacle signal contacts 124 and another row of receptacle signal contacts 124 that is either above or below the other receptacle signal contacts 124.

In an exemplary embodiment, the holder 214 includes slots 364 in the bottom 228 thereof that receive the ground tabs 320 therein when the ground shield 200 is coupled thereto. In an exemplary embodiment, the slots 364 are offset with respect to the receptacle signal contacts 124. When the ground tabs 320 are received in the slots 364, the ground pins 316 are positioned between the receptacle signal contacts 124. For example, the ground pins 316 may be positioned forward and/or rearward of corresponding receptacle signal contacts 124. In an exemplary embodiment, the ground pins 316' are generally aligned (e.g. front-to-back) with the receptacle signal contacts 124 of the dielectric frame 240 and the ground pins 316" are generally aligned (e.g. front-to-back) with the receptacle signal contacts 124 of the dielectric frame 242.

Figure 3:
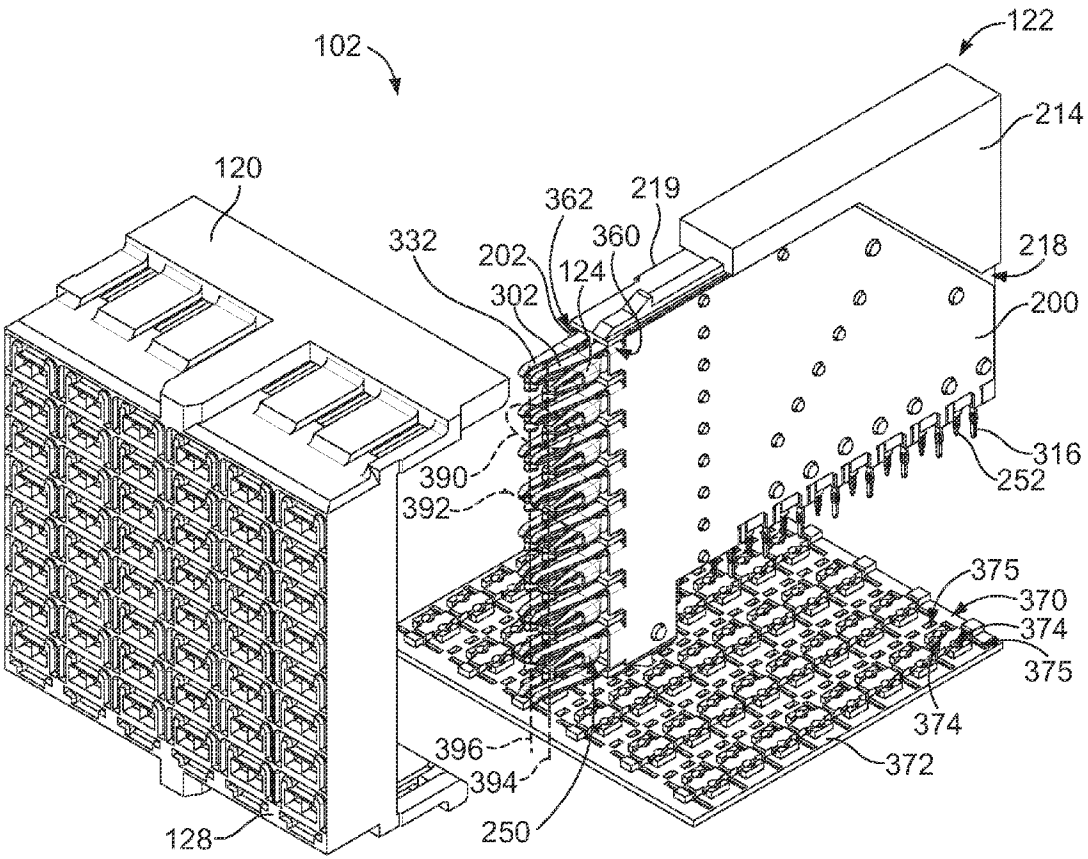
FIG. 3 is an exploded view of the receptacle assembly showing one of the contact modules poised for loading into a front housing of the receptacle assembly.

FIG. 3 is an exploded view of the receptacle assembly 102 showing one of the contact modules 122 poised for loading into the front housing 120. FIG. 3 also illustrates a contact spacer 370 used to organize and/or hold the contact tails 252 and ground pins 316, 346 (shown in FIG. 2). Only one contact module 122 is illustrated in FIG. 3, and it is realized that any number of contact modules 122 may be loaded into the front housing 120 during assembly of the receptacle assembly 102.

Figure 4:
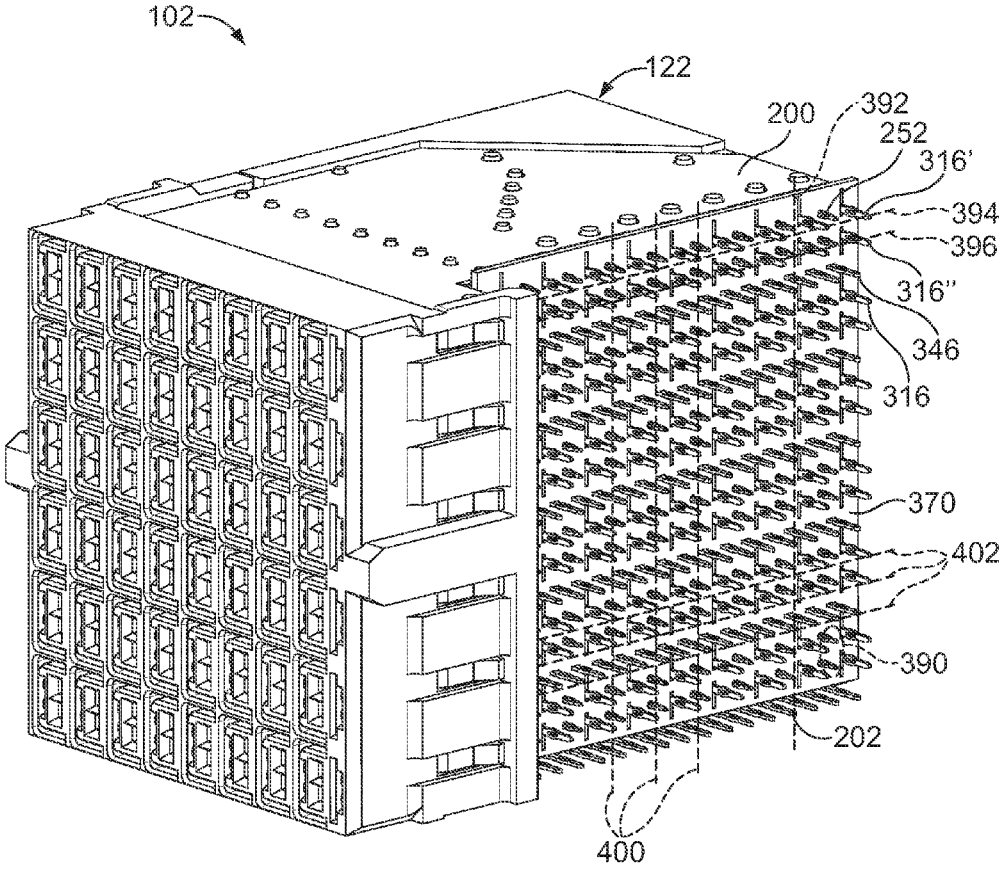
FIG. 4 is a bottom perspective view of the receptacle assembly.

During assembly of the contact module 122, the dielectric frames 240, 242 (shown in FIG. 2) are received in the holder 214. The holder 214 supports and surrounds both dielectric frames 240, 242. The dielectric frames 240, 242 are aligned adjacent one another and may abut against one another. The receptacle signal contacts 124 of both dielectric frames 240, 242 are aligned with one another and define contact pairs 390. Each contact pair 390 is configured to transmit differential signals through the contact module 122. The receptacle signal contacts 124 within each contact pair 390 are arranged in rows that extend along row axes 392. The receptacle signal contacts 124 within the dielectric frame 240 are arranged within a column along a column axis 394. Similarly, the receptacle signal contacts 124 of the dielectric frame 242 are arranged in a column along a column axis 396. In the illustrated embodiment, at the mating end 128, the rows are oriented horizontally and the columns are oriented vertically, however it is noted that at the contact tails 252, the columns, and thus the column axes 394, 396, as shown in FIG. 4, are oriented horizontally. Other orientations are possible in alternative embodiments.

The first and second ground shields 200, 202 are coupled to the holder 214 to provide shielding for the receptacle signal contacts 124. When assembled, the first ground shield 200 is positioned exterior of, and along, the open first side 218. The grounding beams 302 extend into the slots 360 and are generally aligned with the mating portions 250 along the column axis 394. When assembled, the second ground shield 202 is positioned exterior of, and along, the second side 219. The grounding beams 332 extend into the slots 362 and are generally aligned with the mating portions 250 along the column axis 396. The first and second ground shields 200, 202 are configured to be electrically connected to the header shields 146 when the receptacle assembly 102 is coupled to the header assembly 104 (both shown in FIG. 1).

The grounding beams 302, 332 provide shielding for the receptacle signal contacts 124 in the dielectric frame 240 and the dielectric frame 242, respectively. The grounding beams 302, 332 are aligned with the contact pairs 390 along the column axis 394 and the column axis 396. In an exemplary embodiment, one set of grounding beams 302, 332 is provided below the lowermost contact pair 390, another set of grounding beams 302, 332 is provided above the uppermost contact pair 390, and other sets of grounding beams 302 is provided between each of the contact pairs 390. Each of the contact pairs 390 is thereby shielded both above and below its respective row axis 392.

The contact spacer 370 includes a base 372 having a plurality of openings 374, 375 therethrough. The base 372 is manufactured from a dielectric material. The openings 374 are configured to receive corresponding contact tails 252 and the openings 375 are configured to receive ground pins 316, 346. The openings 374, 375 are arranged in rows and columns that correspond to the positioning of the contact tails 252 and ground pins 316, 346. Openings 375 for the ground pins 316, 346 tend to surround (e.g. forward, rearward, and both sides) the openings 374 for the contact tails 252. The ground pins 316, 346 are positioned all around the pairs of contact tails 252. In an exemplary embodiment, a column of openings 375 for the ground pins 346 are arranged between the columns of openings 374 for the contact tails 252 (e.g. between the contact modules). Rows of openings 375 for the ground pins 316 are arranged between the rows of openings 374 for the pairs of contact tails 252. Other configurations of openings 374 are possible in alternative embodiments.

The contact spacer 370 holds the contact tails 252 and ground pins 316, 346 at predetermined positions for mating with the circuit board 106. The contact spacer 370 is coupled to all of the contact modules 122 after all of the contact modules 122 are received in the front housing 120. The receptacle assembly 102 may then be mounted to the circuit board 106 as a unit.

FIG. 4 is a bottom perspective view of the receptacle assembly 102. The ground pins 316, 346 extend from the ground shields 200, 202 through the contact spacer 370. The ground pins 316 are positioned directly below the contact modules 122 between the pairs 390 of contact tails 252. The ground pins 316 are aligned in rows along row axes 400, where each row of ground pins 316 includes ground pins 316 from each of the contact modules 122. The ground pins 316', 316" are generally aligned with corresponding contact tails 252 along the column axes 394, 396, respectively. The ground pins 316 are interspersed between each pair of contact tails 252.

The ground pins 346 are positioned between the columns of contact tails 252. The ground pins 346 are positioned generally directly below the second ground shields 202. The ground pins 346 are positioned generally directly below the interfaces between adjacent contact modules 122. The ground pins 346 are aligned in columns along column axes 402, where each column of ground pins 346 includes all of the ground pins 346 from the corresponding second ground shield 202. Optionally, the ground pins 346 may be offset rearward and forward, respectively, of the rows 400 of ground pins 316 such that the ground pins 346 are not directly in line with the contact tails 252, but rather are staggered slightly forward and rearward of the contact tails 252.

Figure 5:
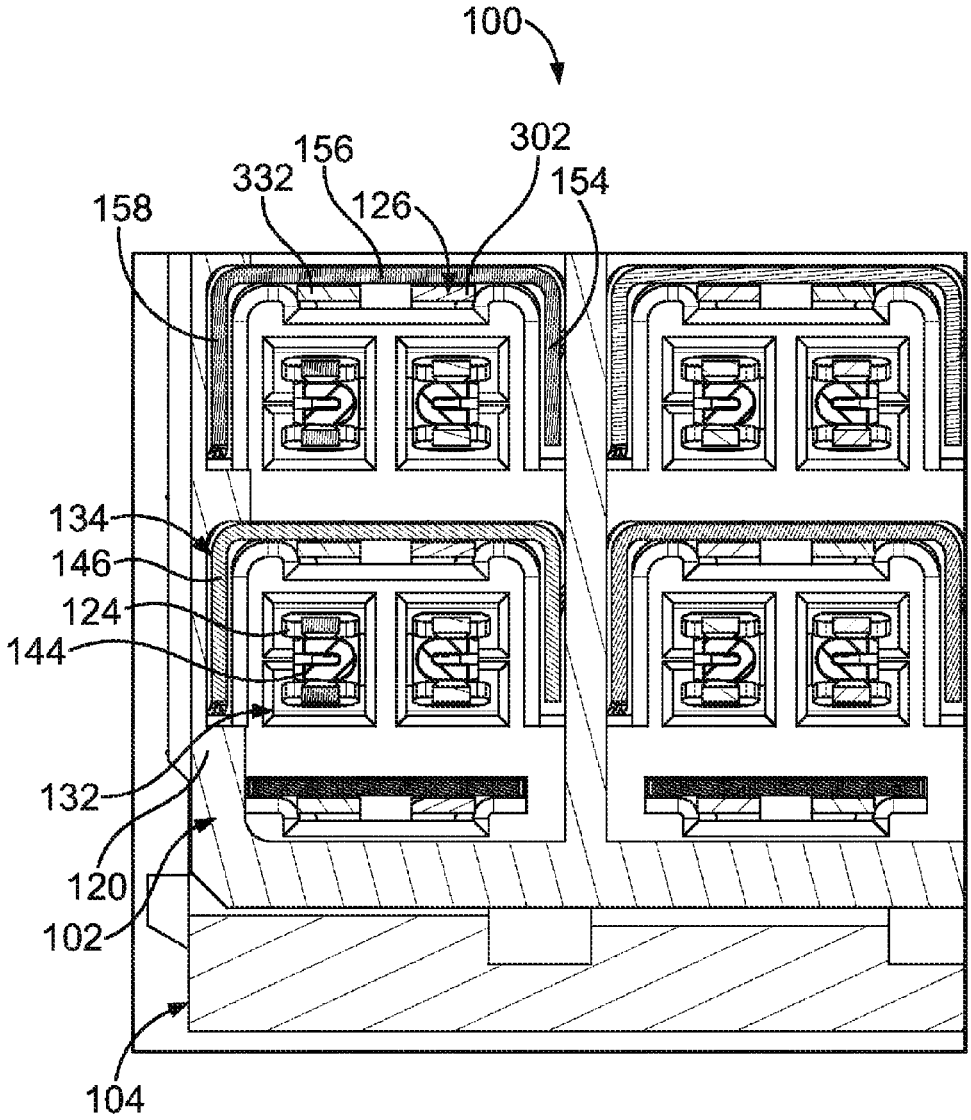
FIG. 5 is a partial sectional view of a portion of the electrical connector system showing the receptacle assembly mated to the header assembly.

FIG. 5 is a partial sectional view of a portion of the electrical connector system 100 showing the receptacle assembly 102 mated to the header assembly 104. The grounding electrical connection between the shield structure 126 and the header shields 146 is illustrated in FIG. 5. The first and second ground shields 200, 202 (shown in FIG. 2) are electrically connected to corresponding header shields 146.

The front housing 120 of the receptacle assembly 102 includes the signal contact openings 132 and the ground contact openings 134. When the header assembly 104 and receptacle assembly 102 are mated, the header signal contacts 144 are mated to the receptacle signal contacts 124 within the signal contact openings 132. The header shields 146 are received in the ground contact openings 134. The grounding beams 302, 332 engage and are electrically connected to corresponding header shields 146 within the ground contact openings 134. The grounding beams 302, 332 engage the main wall 156 of the C-shaped header shields 146 to make electrical connection therewith. In an exemplary embodiment, the grounding beams 302, 332 are deflectable and are configured to be spring biased against the header shields 146 to ensure electrical connection with the header shields 146.

In an exemplary embodiment, the header shields 146 and the shield structure 126 provide 360° shielding for the receptacle signal contacts 124. For example, the side walls 154 extend along first sides of the receptacle signal contacts 124 to provide shielding along such sides of the receptacle signal contacts 124. The side walls 158 extend along second sides of the receptacle signal contacts 124 to provide shielding along such sides of the receptacle signal contacts 124. The header shields 146 thus provide shielding between corresponding columns of the receptacle signal contacts 124, such as between receptacle signal contacts 124 held within different contact modules 122. The grounding beams 302, 332 and the main wall 156 both extend along the receptacle signal contacts 124. The main wall 156 and grounding beams 302, 332 provide shielding between rows of receptacle signal contacts 124.

The shield structure 126 has multiple, redundant points of contact with each of the C-shaped header shields 146. For example, two points of contact are defined by the grounding beams 302, 332. The electrical performance of the electrical connector system 100 is enhanced with multiple ground contact points to the C-shaped header shield 146, as compared to systems that have a single ground contact point.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing configured for mating with a header assembly; and a plurality of contact modules coupled to the front housing, each contact module comprising:

a conductive holder having an open first side and a closed second side, the conductive holder having a chamber between the first and second sides, the conductive holder having a front coupled to the front housing;

a frame assembly received in the chamber through the open first side, the frame assembly comprising a first dielectric frame having a plurality of contacts and a second dielectric frame having a plurality of contacts, the first and second dielectric frames both being received in the chamber of the conductive holder such that the conductive holder surrounds the frame assembly and provides electrical shielding around the frame assembly, the contacts extending from the conductive holder for electrical termination; and a ground shield discrete from the conductive holder and coupled to the conductive holder and closing the open first side, the ground shield being electrically connected to the conductive holder, the ground shield having grounding beams extending forward of the front of the conductive holder for electrical connection to a corresponding header shield of the header assembly.

2. The receptacle assembly of claim 1, wherein the chamber has a depth, the first and second dielectric frames having combined thicknesses approximately equal to the depth of the chamber.

3. The receptacle assembly of claim 1, wherein the first and second dielectric frames are both loaded into the chamber through the open first side.

4. The receptacle assembly of claim 1, wherein the conductive holder has a bottom substantially perpendicular to the front, the first and second sides being substantially perpendicular to the front and the bottom.

5. The receptacle assembly of claim 1, wherein the ground shield includes a planar main body and ground pins extending from a bottom of the main body, the ground pins being bent generally perpendicular to the main body and extending into the first dielectric frame.

6. The receptacle assembly of claim 1, wherein the ground shield includes ground pins extending from a bottom of the ground shield, the ground pins extending into the first dielectric frame and the second dielectric frame, the ground pins being interspersed between corresponding contacts of the first and second dielectric frames.

7. The receptacle assembly of claim 1, wherein the contacts of the first dielectric frame are arranged in a first column, the contacts of the second dielectric frame are arranged in a second column, the ground shield including a plurality of ground tabs extending therefrom into the first and second dielectric frames, each ground tab having a first ground pin and a second ground pin, the first ground pin being aligned with the first column of contacts, the second ground pin being aligned with the second column of contacts.

8. The receptacle assembly of claim 1, further comprising a second ground shield coupled to the second side of the conductive holder, the second ground shield being electrically connected to the conductive holder, the second ground shield having grounding beams extending forward of the front of the conductive holder for electrical connection to a corresponding header shield of the header assembly.

9. The receptacle assembly of claim 8, wherein the contacts of the first and second dielectric frames have contact tails extending therefrom, the contact tails being configured to be terminated to a circuit board, the second ground shield comprising a plurality of ground pins extending therefrom, the ground pins of the second ground shield being offset from the contact tails, the other ground shield having a plurality of ground pins extending therefrom, the ground pins of such ground shield being positioned between corresponding contact tails.

10. The receptacle assembly of claim 8, wherein the second ground shield includes a plurality of ground pins extending therefrom, such ground pins being substantially aligned with the second ground shield, the other ground shield having a plurality of ground pins, such ground pins being substantially aligned with the first and second dielectric frames.

11. A receptacle assembly comprising:

a front housing configured for mating with a header assembly, the front housing having contact openings therethrough;

a contact module coupled to the front housing, the contact module including a conductive holder having an open first side and a closed second side, the conductive holder having a chamber between the first and second sides, the conductive holder having a front coupled to the front housing;

a frame assembly received in the chamber through the open first side, the frame assembly comprising a first dielectric frame having a plurality of contacts and a second dielectric frame having a plurality of contacts, the first and second dielectric frames both being received in the chamber of the conductive holder such that the conductive holder surrounds the frame assembly and provides electrical shielding around the frame assembly, the contacts extending from the conductive holder into corresponding contact openings for electrical termination to header contacts of the header assembly;

a first ground shield discrete from the conductive holder and coupled to the conductive holder and closing the open first side, the first ground shield being electrically connected to the conductive holder, the first ground shield having grounding beams extending forward of the front of the conductive holder into corresponding contact openings for electrical connection to a wall of a corresponding C-shaped header shield of the header assembly; and a second ground shield discrete from the conductive holder and coupled to the second side of the conductive holder, the second ground shield being electrically connected to the conductive holder, the second ground shield having grounding beams extending forward of the front of the conductive holder into corresponding contact openings for electrical connection to a wall of a corresponding C-shaped header shield of the header assembly.

12. The receptacle assembly of claim 11, wherein the chamber has a depth, the first and second dielectric frames having combined thicknesses approximately equal to the depth of the chamber.

13. The receptacle assembly of claim 11, wherein the first and second dielectric frames are both loaded into the chamber through the open first side.

14. The receptacle assembly of claim 11, wherein the conductive holder has a bottom substantially perpendicular to the front, the first and second sides being substantially perpendicular to the front and the bottom.

15. The receptacle assembly of claim 11, wherein the first ground shield includes a planar main body and ground pins extending from a bottom of the main body, the ground pins being bent generally perpendicular to the main body and extending into the first dielectric frame.

16. The receptacle assembly of claim 11, wherein the first ground shield includes ground pins extending from a bottom of the ground shield, the ground pins extending into the first dielectric frame and the second dielectric frame, the ground pins being interspersed between corresponding contacts of the first and second dielectric frames.

17. The receptacle assembly of claim 11, wherein the contacts of the first dielectric frame are arranged in a first column, the contacts of the second dielectric frame are arranged in a second column, the first ground shield including a plurality of ground tabs extending therefrom into the first and second dielectric frames, each ground tab having a first ground pin and a second ground pin, the first ground pin being aligned with the first column of contacts, the second ground pin being aligned with the second column of contacts.

18. The receptacle assembly of claim 11, wherein the contacts of the first and second dielectric frames have contact tails extending therefrom, the contact tails being configured to be terminated to a circuit board, the second ground shield comprising a plurality of ground pins extending therefrom, the ground pins of the second ground shield being offset from the contact tails, the first ground shield having a plurality of ground pins extending therefrom, the ground pins of the first ground shield being positioned between corresponding contact tails.

19. The receptacle assembly of claim 11, wherein the second ground shield includes a plurality of ground pins extending therefrom, such ground pins being substantially aligned with the second ground shield, the first ground shield having a plurality of ground pins, ground pins of the first ground shield being substantially aligned with the first and second dielectric frames.

20. An electrical connector assembly comprising:

a header assembly comprising a header housing, a plurality of header contacts held by the header housing, and a plurality of C-shaped header shields surrounding corresponding header contacts on three sides, the header shields having walls defining the C-shaped header shields; and a receptacle assembly matable to the header assembly, the receptacle assembly comprising:

a front housing matable to the header housing;

a contact module coupled to the front housing, the contact module including a conductive holder having an open first side and a closed second side, the conductive holder having a chamber between the first and second sides, the conductive holder having a front coupled to the front housing;

a frame assembly received in the chamber through the open first side, the frame assembly comprising a first dielectric frame having a plurality of contacts and a second dielectric frame having a plurality of contacts, the first and second dielectric frames both being received in the chamber of the conductive holder such that the conductive holder surrounds the frame assembly and provides electrical shielding around the frame assembly, the contacts extending from the conductive holder for electrical termination to corresponding header contacts; and a ground shield discrete from the conductive holder and coupled to the conductive holder and closing the open first side, the ground shield being electrically connected to the conductive holder, the ground shield having grounding beams extending forward of the front of the conductive holder for electrical connection to a corresponding wall of a corresponding header shield.

* * * * *